US009142106B2

(12) United States Patent
Jerhotova et al.

(10) Patent No.: US 9,142,106 B2
(45) Date of Patent: Sep. 22, 2015

(54) TAILGATING DETECTION

(75) Inventors: Eva Jerhotova, Prague (CZ); Valerie Guralnik, Mound, MN (US)

(73) Assignee: Honeywell International, Inc., Morristown, NJ (US)

( * ) Notice: Subject to any disclaimer, the term of this patent is extended or adjusted under 35 U.S.C. 154(b) by 552 days.

(21) Appl. No.: 13/478,708

(22) Filed: May 23, 2012

(65) Prior Publication Data

US 2013/0314232 A1 Nov. 28, 2013

(51) Int. Cl.

| | |
|---|---|
| ***G08B 13/00*** | (2006.01) |
| ***G08B 29/18*** | (2006.01) |
| *G08B 13/08* | (2006.01) |
| *G08B 13/196* | (2006.01) |

(52) U.S. Cl.

CPC ..... *G08B 13/00* (2013.01); *G08B 29/185* (2013.01); *G08B 13/08* (2013.01); *G08B 13/19613* (2013.01)

(58) Field of Classification Search

None

See application file for complete search history.

(56) References Cited

U.S. PATENT DOCUMENTS

| | | | | |
|---|---|---|---|---|
| 2004/0036574 | A1* | 2/2004 | Bostrom | 340/5.82 |
| 2004/0153671 | A1* | 8/2004 | Schuyler et al. | 713/201 |
| 2008/0223927 | A1* | 9/2008 | Otaka et al. | 235/382 |
| 2008/0285802 | A1* | 11/2008 | Bramblet et al. | 382/103 |
| 2009/0002144 | A1* | 1/2009 | Bernard et al. | 340/426.24 |
| 2009/0307255 | A1 | 12/2009 | Park | |
| 2012/0008836 | A1* | 1/2012 | Bobbitt et al. | 382/113 |
| 2013/0085588 | A1 | 4/2013 | Brun et al. | |
| 2013/0201286 | A1* | 8/2013 | Schockmel et al. | 348/46 |

OTHER PUBLICATIONS

Artur Krukowski, et al. Comprehensive Building Information Management System Approach. International Journal of Simulation Systems, Science & Technology, vol. 11, No. 3, pp. 12-28, May 2010.

Andreas Fernbach, et al. Interoperability at the Management Level of Building Automation Systems: A Case Study for BACnet and OPC UA, IEEE ETFA. pp. 1-8. 2011.

* cited by examiner

*Primary Examiner* — Curtis King

(74) *Attorney, Agent, or Firm* — Brooks, Cameron & Huebsch, PLLC

(57) ABSTRACT

Methods, systems, and computer-readable media for tailgating detection are described herein. One method includes collecting, via a computing device, access log data associated with a profile; processing, by a processor coupled to the computing device, the access log data to obtain a statistical access model; detecting, by the processor, a tailgating sequence based on the statistical access model; and providing, by the processor, a notification that the tailgating sequence has occurred.

20 Claims, 4 Drawing Sheets

TAILGATING DETECTION

TECHNICAL FIELD

The present disclosure relates to methods, systems, and computer-readable media for tailgating detection.

BACKGROUND

Access control systems can be used to exert control over who can interact with a resource. For example, an access control system may be implemented to control access to resources such as buildings, rooms, and/or computers. Recently, individual security cards have been increasingly used in connection with physical security systems for access control. The security cards may be used to monitor and/or control access to physical facilities by interfacing the security cards with access control device equipment deployed at various locations within and/or surrounding the facility.

Although previous access control systems can be adequate when used as intended, tailgating can circumvent such security measures. In the physical security domain, tailgating can be defined as bypassing access control devices or other checkpoints to gain entry into a restricted area, for example by an unauthorized individual following an authorized individual into a restricted area. In such situations, the authorized individual can allow other individuals in by holding the door open and/or by failing to secure the door after passing through, for example. Tailgating constitutes a serious gap in access control security.

DETAILED DESCRIPTION

Figure 1:
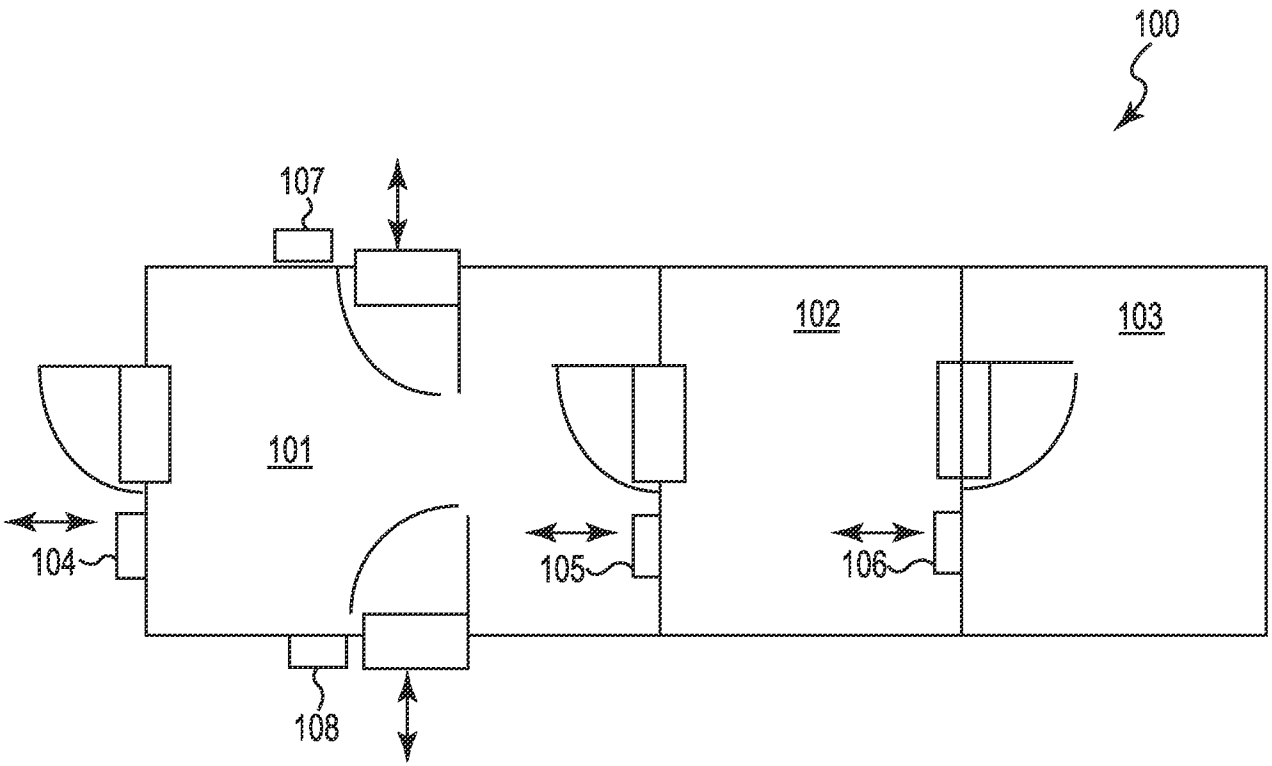
FIG. 1 illustrates an example of a schematic view of a facility using a spatial model according to one or more embodiments of the present disclosure.

Methods, systems and computer-readable media for tailgating detection are described herein. For example, one or more embodiments include collecting, via a computing device, access log data associated with a profile, processing, by a processor coupled to the computing device, the access log data to obtain a statistical access model, detecting, by the processor, a tailgating sequence based on the statistical access model, and providing, by the processor, a notification that the tailgating sequence has occurred.

Tailgating detection (e.g., by access log data analysis) in accordance with one or more embodiments of the present disclosure can be used in the physical security domain, for example. However embodiments of the present disclosure are not so limited. Examples of monitoring and control in the physical security domain include tracking individual movement through various access points and/or allowing only certain individuals to access particular areas and/or equipment.

Tailgating can be defined as bypassing access control devices or other checkpoints to gain entry into a restricted area, for example by an unauthorized individual following an authorized individual into a restricted area. In such situations, the authorized individual can allow other individuals in by holding the door open and/or by failing to secure the door after passing through, for example. Tailgating can circumvent physical security measures designed to protect secret, dangerous, or otherwise sensitive areas and/or equipment. Accordingly, preventing tailgating to maintain the physical security of a room, building, or series of rooms and/or buildings can be desirable.

To prevent tailgating, a statistical access model can be used to determine whether a particular access event is a tailgating event or a valid access event (e.g., an intended access by an intended individual). Alternatively and/or additionally, the statistical access model can be used for classifying access event types and/or classifying behavior patterns of access system users. In some examples, access event types can be separated and/or grouped into event types, such as, for example, maintenance event types (e.g., maintenance personnel accessing areas), cleaning access event types (e.g., janitorial staff accessing areas), and/or project access events (e.g., project team members accessing areas), although examples are not so limited. Classifying behavior patterns of access system users can include separating and/or grouping user behavior patterns based on their interaction with the access system.

The statistical access model can be assigned to an individual, a group of individuals, an access control device, and/or a group of access control devices. In some examples, the statistical access model can be built (e.g., created) over a period of time, for example, days, weeks, and/or months. Alternatively and/or additionally, in some examples, the statistical access model can be built (e.g., created) using historical data. The historical data can include, for example, past access log data associated with access events associated with a location, an individual, an access control device, a group of locations, a group of individuals, and/or a group of access control devices, among other suitable data for building the model.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits.

As used herein, "a" or "a number of" something can refer to one or more such things. For example, "a number of energy loads" can refer to one or more energy loads. Additionally, the designators "L", "M", "N", and "P" as used herein, particularly with respect to reference numerals in the drawings, indicate that a number of the particular feature so designated can be included with a number of embodiments of the present disclosure.

FIG. 1 illustrates an example of a schematic view of a facility 100 according to one or more embodiments of the present disclosure. As illustrated in FIG. 1, facility 100 includes a number of access control devices 104, 107, 108 to control access to the facility 100 and/or to a series of rooms 101, 102, 103 located within the facility 100. Although the embodiment illustrated in FIG. 1 includes three access control devices and three rooms, embodiments of the present disclosure are not limited to a particular number of access control devices or rooms.

The access control device 104, 107, 108 can be an existing or a newly installed (e.g., placed at an entrance to a location) access control device, that reads an identification token (e.g., key card, magnetic badge, wireless identification tag, etc.). In some embodiments, the identification token can include photographs, relevant personal data, biometric data, and/or other identifying information to permit verification of the cardholders' identity can be contained on security cards.

The access log data associated with the profile can include, for example, a time of an access event (e.g., the time of day the access event occurs), a duration of the access event (e.g., how long an individual and/or group of individuals are at a location), a day of the access event (e.g., the date and/or day of the week the access event occurs), an identification of an individual and/or access control device 104, 107, 108 associated with the access event, a time of a first access event associated with a location (e.g., the time of day the location is first accessed), a previous and/or a subsequent access control devices 104, 107, 108 accessed by the individual, a time between the previous and subsequent access to the previous and subsequent access control devices 104, 107, 108, whether the individual can be identified as a tailgater and/or allowing tailgating, a frequency of access events associated with the location, a job title of the individual accessing the access control device and/or a job title of the individual that works in the location that the access control device, a job description of the individual and/or the job that can be performed by the individual in the location that the access control device is employed, and/or a project description, and/or a description of the project that is being worked on in the location that the access control device is employed, among other examples of access log data.

In some embodiments, an initial access to the facility 100 can occur through one of the number of access control devices 104, 107, or 108. Once in the room 101, room 102 can be accessed via access control device 105. Once in room 102, room 103 can be accessed via access control device 106. As depicted in FIG. 1, the access control device can be located at substantially the location of an access point (e.g., a doorway).

Using this model, an example sequence of access control devices can be [104, 105, 106]. This example signifies an individual passing in a single direction of travel through access control devices 104, 105, and 106 sequentially (e.g., first through access control device 104, then through access control device 105, and then through access control device 106). This sequence can be split into subsequences, for example, [104, 105], [105, 106], and [104, 106].

However, the present disclosure is not limited to such a sequence and/or model. The direction of travel and/or a number of directions of travel by the individual and a corresponding reader sequence(s) are not so limited. Additionally, in the example model, the access control devices are positioned substantially at each access point (e.g., doorway) to the room 101, 102, and/or 103. In some examples, the model can include rooms (e.g., a small store-room and/or lavatory) and/or the access points (e.g., doorways) without an access control device.

In some embodiments, occurrence probabilities for the sequence and/or subsequences can be determined (e.g., computed). For example, (P(104 before 105 before 106), representing the probability associated with access control device 104 being accessed before access control devices 105 and 106 can be computed. Additionally, in some examples, probabilities of subsequences, (e.g., (P(104 before 105), (P(104 before 106), (P(106 after 104), and (P(106 after 105)) can be computed.

In some embodiments, a threshold can be applied to the computed probabilities to determine subsequences and/or sequences that have significantly lower probability of occurrence than other (e.g., potentially valid) subsequences and/or sequences. In some embodiments, those sequences with a lower probability of occurrence (e.g., below the threshold) can be identified as tailgating sequences. In addition, in some embodiments, detecting a tailgating sequence can be based on one or more thresholds and/or a time period associated with the access log data contained in the statistical access model relating to one or more access control devices. That is, in some embodiments, the detecting a tailgating sequence includes alteration of the one or more thresholds and/or alteration of the time period relating to the access log data associated with to one or more access control devices (e.g., 104), as described herein.

For example, a spatial model (e.g., a Building Information management (BIM) model) can provide information about access control device positions and/or room connectivity. In some examples, the sequences of access control devices and related data from the access log data can be mapped to the spatial model. In some embodiments, the spatial model can rendered and/or displayed, as described further herein.

Alternatively and/or additionally, in some embodiments, tailgating routes can be contiguous sequences of access control devices in historical access log data that cannot be generated in any other way than tailgating one or more access control devices. For example, using the example sequence [104, 105, 106] above, [104, 106] can be identified as a tailgate route due to access control devices 104 and 106 being separated and/or only accessible by access control device 105. Alternatively and/or additionally, an individual access control device can generate tailgating sequence information.

In some embodiments, the access control information and/or resulting tailgating sequences can be filtered and/or cleansed. Filtering can include sorting the sequences by probability of sequence occurrence, access control device location, individual(s) proceeding through access control devices, time period of accessing a particular location and/or access control devices and/or by other items of interest. Cleansing can include using access control device location information stored in an access control system database to eliminate sequences as impossible. For example, if access control device 104 is located in facility 100 and access control device X is located in an entirely different physical location (e.g., facility), then the sequence of access control device 104 followed by access control device X can be cleansed (e.g., eliminated from the possible tailgating sequences).

After a tailgating sequence has been identified, a notification that the tailgating sequence has occurred can be provided. The notification can be provided via off-line and/or on-line methods, among others. On-line methods can provide direct notification (e.g., via a graphical display) and off-line methods can provide indirect notification (e.g., via a list). Alternatively, in some examples, notification can include on-line and off-line methods.

Figure 2:
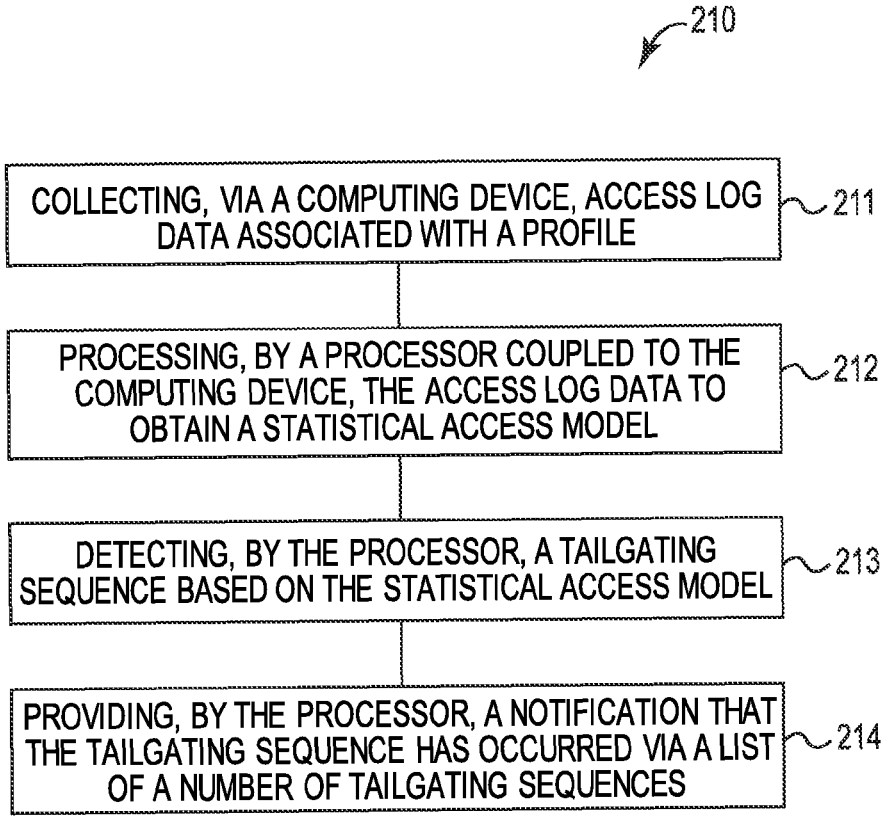
FIG. 2 illustrates an off-line method for tailgating detection according to one or more embodiments of the present disclosure.

FIG. 2 illustrates an off-line method 210 for tailgating detection according to one or more embodiments of the present disclosure. As illustrated in FIG. 2, off-line method 210 can include collecting (e.g., via a computing device such as computing device 430 described in connection with FIG. 4) access log data associated with a profile at block 211, processing (e.g., by a processor coupled to the computing device such as processor 432 described in connection with FIG. 4) the access log data to obtain a statistical access model at block 212, detecting (e.g., by the processor) a tailgating sequence based on the statistical access model at block 213, and providing (e.g., by the processor) a notification that the tailgating sequence has occurred via a list at block 214.

The list can include a number of detected tailgating sequences (e.g., routes) and/or tailgated access control devices. In some embodiments the list can include detected tailgating routes and/or tailgated access control devices ranked according to their statistical significance. That is, in some embodiments, the list of the number of tailgating sequences can be ranked according to statistical significance using statistical means, as discussed herein.

The list can be generated either as a physical document (e.g., via a printer coupled to the computing device) and/or in electronic form (e.g., as an email and/or an attachment in an email). An analyst can use this information for supporting the decision to place additional sensors (e.g. video cameras), add additional access control devices in selected areas for their better monitoring, and/or to introduce changes to the alarm system configuration, etc.

As used herein, tailgating detection can be performed by processing the access log data to obtain a statistical access model. Alternatively and/or additionally, the method of obtaining the statistical access model can utilize a spatial model of the building, as discussed herein in relation to FIG. 1.

In some embodiments, the statistical access model can, for example, be built (e.g., created) using historical data associated with access events (e.g., the number of access events) associated with a location, an individual, an access control device, a group of locations, a group of individuals, and/or a group of access control devices. That is, the statistical access model can be built using data associated with previous access events associated with a location, an individual, a group of locations, and/or a group of individuals, among other suitable data for building the model. In some embodiments, obtaining the statistical access model can include mining the access control device sequence information from the access log data and identifying segments of these sequences that have significantly lower probability of occurrence than other (e.g., valid) subsequences.

In some embodiments, method 210 can include detecting the average time between access events (e.g., card swipes) to get an expected access event time interval. In some embodiments, the average time between card swipes for one or more identified access control devices can be determined using a probability distribution analysis. This probability distribution analysis can be based on, for example, an analysis of the interval between the minimum and the maximum value of the time between swipes. In some embodiments, statistical means can be applied to analyze the interval between card swipes, for example, calculating a mean value (e.g., average time) between card swipes, and/or determining the confidence interval for the mean value.

In some embodiments, access log data associated with tailgating event can be compared to access log data associated with a valid access event. For example, potential tailgating event data associated with a statistical access model at a location (e.g., access control device) can be compared with one or more valid access events associated with the same location.

The potential tailgating routes and/or the average times needed for passing from one access control device to another can be used in conjunction with statistical means, for example, those described above, to obtain a record of tailgated access control devices. In some embodiments, the record can identify tailgating sequences and/or tailgated access control devices. In some embodiments, the potential tailgating routes can be combined with the average time for passing from one access control device to another access control device to obtain a record of tailgated access control devices. In some embodiments, the record can include individuals who often tailgate, individuals who often allow others to tailgate, and/or the average time between card swipes for one or more identified access control device sequences. In some embodiments, the average time (e.g., expected time) needed for passing from one access control device to another can be compared to measured times and those measured times with a different (e.g., statistically significant difference) time from the expected time can be recorded as tailgating routes.

Figure 3:
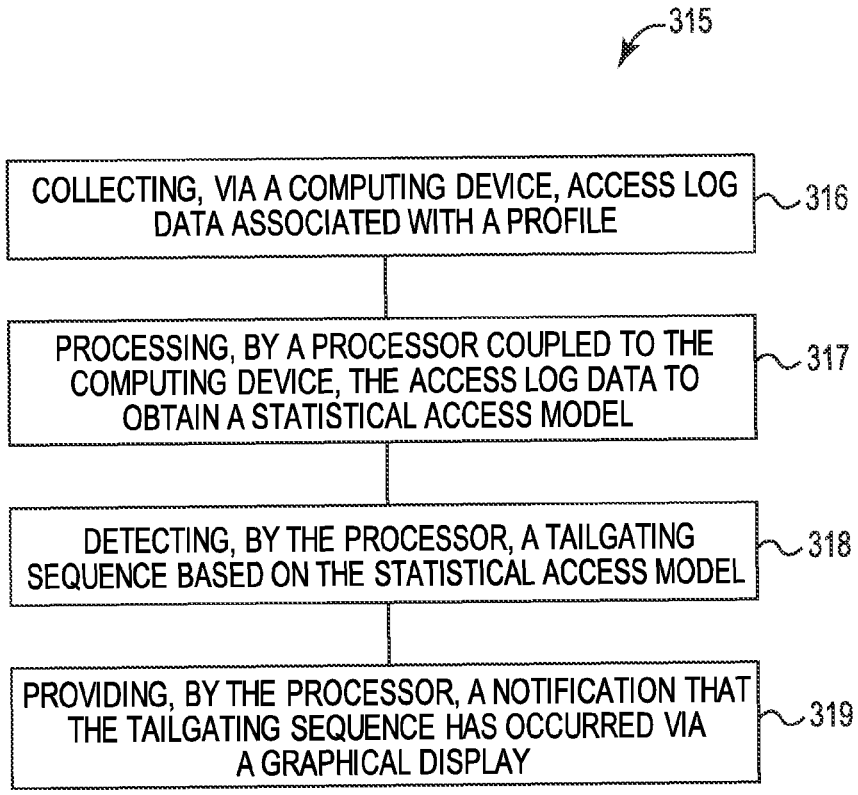
FIG. 3 illustrates an on-line method for tailgating detection according to one or more embodiments of the present disclosure.

FIG. 3 illustrates an on-line method 315 for tailgating detection according to one or more embodiments of the present disclosure. As illustrated in FIG. 3, on-line method 315 can include collecting (e.g., via a computing device such as computing device 430 described in connection with FIG. 4) access log data associated with a profile at block 316, processing, (e.g., by a processor coupled to the computing device such as processor 432 described in connection with FIG. 4) the access log data to obtain a statistical access model at block 317, detecting (e.g., by the processor) a tailgating sequence using an algorithm based on the statistical access model at block 318, and providing (e.g., by the processor) a notification that the tailgating sequence has occurred via a graphical display (e.g., a user interface) at block 319.

In some embodiments, method 315 can include providing the notification that the tailgating has occurred based on the detection of the tailgating sequence. For example, the notification (e.g., alert) can be provided to an operator that tailgating has occurred, for example, by using the methods described herein.

In some embodiments, the operator can be alerted when a card swipe is expected, as detailed above, but does not take place. In some embodiments, the operator can be located in the same relative physical location as the access control system and/or at a remote site.

In some embodiments, the graphical display can include a graphical representation including, displaying a visual rendering (e.g., two and/or three dimensional) on a screen at one or more locations in association with the graphical representation identifying accessed regions of a building as indicated by the access log data, displaying a graphical representation of an access control device on the screen, and/or providing open, closed, and/or tailgate indicators to visually indicate the open, closed, and/or tailgate status at the corresponding graphical representation of the access control device.

In some embodiments, displaying the graphical representation can include: providing a legend to indicate that the distinctive attributes of the series of display elements pertain to accesses initiated to the particular individual and that the particular individual initiated the respective access to the access control device, displaying a series of display elements with distinctive attributes to indicate that the respective access was initiated by a particular individual, displaying the location of the access control device on the screen relative to its location in the building, displaying a time interval between relative open and closed status of each access control device, and/or displaying a time interval between the relative close status of one access control device and the relative open status of a second access control device. In some embodiments, the graphical representation can include a rendering of the spatial model.

In some embodiments, a visual rendering can be displayed. In some embodiments, displaying a visual rendering can include: displaying a visual rendering on a screen at one or more locations in association with the graphical representation identifying accessed regions of a building as indicated by the access log data, displaying the graphical representation of an access control device on the screen, providing an indicator representing one or more threshold(s), as describe herein, providing an open or closed indicator at the corresponding graphical representation of the access control device, providing a tailgating sequence indicator, for example, when a tailgating sequence can be detected based on the one or more threshold(s) and a time period (e.g., a 24 hour period), over which the processor 432 process the access log data contained in the statistical access model and/or enabling a user viewing the graphical representation on the display screen to manipulate the representation. In some embodiments, the rendering can be include a rendering of the spatial model.

By way of example and not as a limitation, a manipulation can include scanning across the graphical representation using a pointer based on a current position of the pointer over a region of the graphical representation, providing a numerical display of related information, and/or a variety of other tasks enabling the user to manipulate the graphical representation.

In some embodiments, method 315 can include the placement of additional sensors and/or additional access control devices. The additional sensors can be placed substantially at existing sensor locations (e.g., to provide enhanced security through redundancy) and/or at locations that previously were without a sensor and/or an access control device (e.g., at an entry point to a room and/or building that previously was without the sensor and/or the access control device).

Additionally and/or alternatively, the tailgating detection can be focused on walkthrough areas, for example corridors. The operator can also be alerted when an individual approaches a certain area and/or passes through a certain access control device to monitor an individual who frequently lets other individuals to tailgate approaches or frequently tailgated access control devices. In such situations, the operator can alert security guards, patrol individuals, and/or view the video cameras recordings if available.

This method for tailgating detection by access data analysis can generate a certain amount of false alarms (or false positives). For example, this can be the result of a not fully up-to-date building spatial model. In addition, sequences, which can be valid but that are very infrequent in the historical access log data, can result in a false alarm. In order to eliminate these false alarms, the access control system can be retrained (e.g., by threshold alteration and/or updating to account for changes in the spatial model), for example, by the authorized user).

That is, in some embodiments, one or more input(s) (e.g., thresholds) can be adjusted to reduce false positives, account for spatial model adjustments and/or access control system updates. Examples of adjusting thresholds can include, adjusting the threshold for determining a sequence as tailgating and/or adjusting the time period that a particular access control device sequence can be analyzed, for example. Alternatively and/or additionally, a user can be enabled to change the status of the access control device sequence from "tailgated" to "valid".

Figure 4:
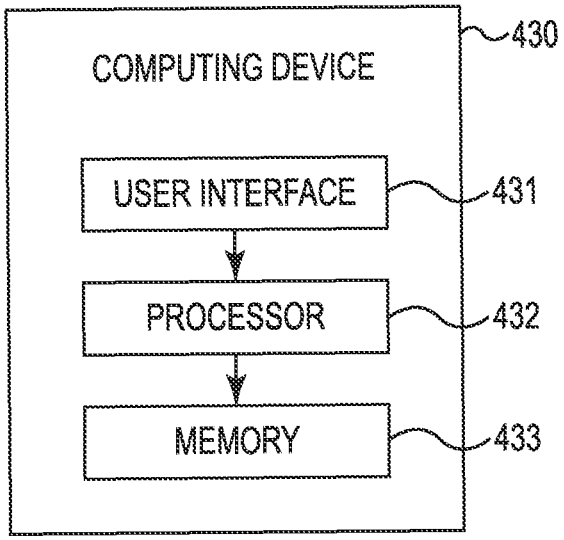
FIG. 4 illustrates a computing device for tailgating detection according to one or more embodiments of the present disclosure.

FIG. 4 illustrates a computing device for tailgating detection according to one or more embodiments of the present disclosure. As illustrated in FIG. 4, a computing device 430 can include a user interface 431 and a memory 433 coupled to a processor 432. The computing device 430 can be, for example, a desktop computing device, a laptop computing device, or a portable handheld computing device, such as, for instance, a portable handheld mobile phone, media player, or scanner. However, embodiments of the present disclosure are not limited to a particular type of computing device. In some embodiments, the computing device 430 can be a part of an access control device and/or a monitoring system.

The user interface 431 can be a graphic user interface (GUI) that can provide (e.g., display and/or present) and/or receive information (e.g., data and/or images) to and/or from a user (e.g., operator) of the computing device 430. For example, the user interface 431 can include a screen that can provide information to a user of the computing device 430 and/or receive information entered into a display on the screen by the user. However, examples of the present disclosure are not limited to a particular type of user interface. In some embodiments, the user can alter inputs (e.g., thresholds) and/or change the status of one or more access control devices (e.g., from "tailgated" to "valid") via the user interface 431.

The memory 433 of the computing device 430 can be volatile or nonvolatile memory. The memory 433 can also be removable (e.g., portable) memory, or non-removable (e.g., internal) memory. For example, the memory 433 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disk read-only memory (CD-ROM)), flash memory, a laser disk, a digital versatile disk (DVD) or other optical disk storage, and/or a magnetic medium such as magnetic cassettes, tapes, or disks, among other types of memory.

Although the memory 433 can be illustrated as being located in computing device 430, embodiments of the present disclosure are not so limited. For example, the memory 433 can also be located internal to another computing resource (e.g., enabling computer readable instructions to be downloaded over the Internet or another wired or wireless connection).

In some embodiments, the memory 433 can also store executable instructions, such as, for example, computer readable instructions (e.g., software), for tailgating detection in accordance with one or more embodiments of the present disclosure.

The processor 432 (e.g., a processing device) can execute the executable instructions stored in the memory 433 for tailgating detection in accordance with one or more embodiments of the present disclosure. For example, the processor 432 can execute the executable instructions stored in the memory 433 to collect data associated with a access profile of an individual and compare that to the expected assess times to determine if a tailgating event has occurred.

In some embodiments, the access profile data, tailgating sequences, expected duration of time for completing a sequence between one or more access control devices and/or tailgating history can be stored on memory 433, which can be located in, for example, a computerized in-house security system, as historical data, along with more extensive data relating to the individual, identification information for example.

Hence, an example of a system for tailgating detection by access log data analysis, as described herein, can include a computing device (e.g., 430) including a processor (e.g., 432), an access control device (e.g., 104) coupled to the computing device (e.g., 430), to obtain access log data, a set of executable instructions, which when executed by the processor (e.g., 432), cause the processor (e.g., 432) to receive the access log data associated with a profile, as described herein.

The system for tailgating detection by access log data analysis can be offered individually to customers and/or as an additional module of the security management product portfolio e.g., PROWATCH, etc). Applications of the system, as described herein, are not limited to such a security management product.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A computer implemented method for tailgating detection, comprising:

collecting, via a computing device, access log data associated with a profile;

processing, by a processor coupled to the computing device, the access log data to obtain a statistical access model including respective probabilities of occurrence associated with a plurality of detected sequences, wherein each sequence of the plurality of detected sequences is representative of traveling through at least two access control devices;

detecting a tailgating sequence included in the plurality of detected sequences as a sequence having a comparatively lower respective probability of occurrence than at least some of the respective probabilities of occurrence associated with the plurality of detected sequences; and providing, by the processor, a notification of the detected tailgating sequence.

2. The method of claim 1, wherein processing the access log data to obtain the statistical access model includes utilizing a spatial model to obtain the statistical access model.

3. The method of claim 1, wherein providing the notification includes generating a list of the detected tailgating sequences.

4. The method of claim 3, wherein the list of the number of tailgating sequences are ranked according to statistical significance.

5. The method of claim 1, wherein providing the notification includes displaying a graphical representation of the access log data and tailgating sequences.

6. The method of claim 5, wherein displaying the graphical representation includes:

displaying a visual rendering on a screen at one or more locations in association with the graphical representation identifying accessed regions of a building as indicated by the access log data;

displaying a graphical representation of an access control device on the screen; and providing open, closed, and tailgate indicators to visually indicate the open, closed, and tailgate status at the corresponding graphical representation of the access control device.

7. The method of claim 1, wherein collecting the access log data associated with a profile further includes classifying the access log data by an access event type.

8. The method of claim 1, wherein collecting the access log data associated with a profile includes collecting at least one of:

a time of an access event;

a day of the access event;

an identification of an individual associated with the access event;

a time of a first access event associated with a location; and a frequency of access events at the location.

9. The method of claim 1, wherein collecting the access log data associated with a profile further includes classifying the access log data by a behavior pattern.

10. The method of claim 1, wherein the method further includes filtering the access log data.

11. A system for tailgating detection, comprising:

a computing device including a processor;

an access control device coupled to the computing device, to obtain access log data; and a set of executable instructions, which when executed by the processor, cause the processor to:

receive the access log data associated with a profile;

process the access log data to obtain a statistical access model including respective probabilities of occurrence associated with a plurality of detected sequences, wherein each sequence of the plurality of detected sequences is representative of traveling through at least two access control devices;

detect a tailgating sequence included in the plurality of detected sequences based on a probability threshold as a sequence having a comparatively lower respective probability of occurrence than at least some of the respective probabilities of occurrence associated with the plurality of detected sequences; and provide a notification of the detected tailgating sequence.

12. The system of claim 11, wherein the instructions are executable to detect a tailgating sequence based on alteration of the probability threshold.

13. The system of claim 11, wherein the instructions are executable detect a tailgating sequence based on alteration of a time period.

14. The system of claim 11, wherein the instructions are executable to provide a graphical representation of the access control device, access log data, and tailgating sequence.

15. The system of claim 11, wherein the system further includes a memory for storing the access log data as historical data.

16. The system of claim 15, wherein the instructions are executable to utilize the historical data to obtain the statistical access model.

17. A computer readable non-transitory medium storing instructions for tailgating detection by access log data analysis, executable by a computer to cause the computer to:

collect access log data associated with a profile;

process the access log data using a spatial model to obtain a statistical access model including respective probabilities of occurrence associated with a plurality of detected sequences, wherein each sequence of the plurality of detected sequences is representative of traveling through at least two access control devices;

provide a graphical representation of the access control device, access log data, and tailgating sequences; and detect a tailgating sequence included in the plurality of detected sequences based on a probability of occurrence threshold as a sequence of two or more physical positions of the at least two access control devices having a comparatively lower respective probability of occurrence than at least some of the respective probabilities of occurrence associated with the plurality of detected sequences, wherein the two or more physical positions are identified in the spatial model.

18. The computer readable non-transitory medium of claim 17 wherein the spatial model comprises a building information model.

19. The computer readable non-transitory medium of claim 17, wherein the instructions are executable to cleanse the access log data.

20. The computer readable non-transitory medium of claim 17, wherein the instructions are executable to detect a tailgating sequence by enabling alteration of the at least one threshold and a time period relating to the access log data.

* * * * *